United States Patent [19]

Ikeda

[11] 4,152,865

[45] May 8, 1979

[54] GREETING CARD WITH HOLDING TOY

[76] Inventor: Seito Ikeda, 1050A, Ninth Ave., Honolulu, Hi. 96816

[21] Appl. No.: 864,858

[22] Filed: Dec. 27, 1977

[51] Int. Cl.[2] ..... A63H 3/10

[52] U.S. Cl. ..... 46/116; 40/124.1; 46/119

[58] Field of Search ..... 40/158 R, 160, 124.1; 46/34–36, 116, 119, 123

[56] References Cited

U.S. PATENT DOCUMENTS

| | | | |
|---|---|---|---|
| 2,651,131 | 9/1953 | Long et al. | 40/124.1 |
| 3,427,642 | 2/1969 | Mohr | 46/123 |
| 3,789,546 | 2/1974 | Morrison | 46/116 |
| 3,928,933 | 12/1975 | Iwamoto | 46/119 |

*Primary Examiner*—Louis G. Mancene
*Assistant Examiner*—Robert F. Cutting
*Attorney, Agent, or Firm*—Fitch, Even & Tabin

[57] ABSTRACT

A greeting card is described in combination with a holding toy preferably in the form of an animal having limbs which are spring-loaded in order to secure the holding toy is place upon the card, the card having decorative indicia on the surface thereof providing a setting for the holding toy, the card also being formed with a cut out portion to receive the holding toy within the outline of the card surface adjacent the decorative indicia.

8 Claims, 3 Drawing Figures

GREETING CARD WITH HOLDING TOY

BACKGROUND OF THE INVENTION

The present invention relates to a greeting card in combination with a holding toy and more particularly to such a combination where the card has a cut out portion to receive the holding toy and the holding toy includes spring-loaded limbs for securing it to the card.

The present invention particularly contemplates a holding toy of the type illustrated and described in U.S. Pat. No. 3,928,933. Accordingly, the abovenoted patent is incorporated by reference herein particularly as to the construction of a holding toy including spring-loaded limbs, as described in detail therein.

SUMMARY OF THE INVENTION

It is an object of the invention to provide a novel and useful greeting card in combination with a holding toy which forms part of decorative indicia upon the card while also being removable from the card.

It is a more particular object of the invention to provide such a combination wherein a portion of the greeting card is cut away to permit the holding toy to be secured to the greeting card within the overall outline of the card.

Preferably, the greeting card is folded to have front and rear hinged panels, one panel forming an overall outline for the card, the other panel including indicia providing a setting for the holding toy and a cut out portion to receive the bear within the general outline formed by the one panel.

The holding toy is also preferably configured in the form of an animal such as a bear, monkey or the like with opposing limbs of the animal, preferably its upper limbs, being internally spring-loaded to provide a clamping action for securing the holding toy to the card. In addition, the holding toy may thereby be removed from the card and secured as a decoration upon other objects by the clamping action of its limbs.

Additional objects and novel features of the invention are made apparent in the following description having reference to the accompanying drawings.

DESCRIPTION OF THE PREFERRED EMBODIMENT

As indicated above, the present invention is directed toward a combination of a greeting card and holding toy, the greeting card including decorative indicia and a cut out portion for receiving the holding toy so that the holding toy forms a portion of the decorative indicia when it is mounted within the cut out portion of the card.

Figure 1:
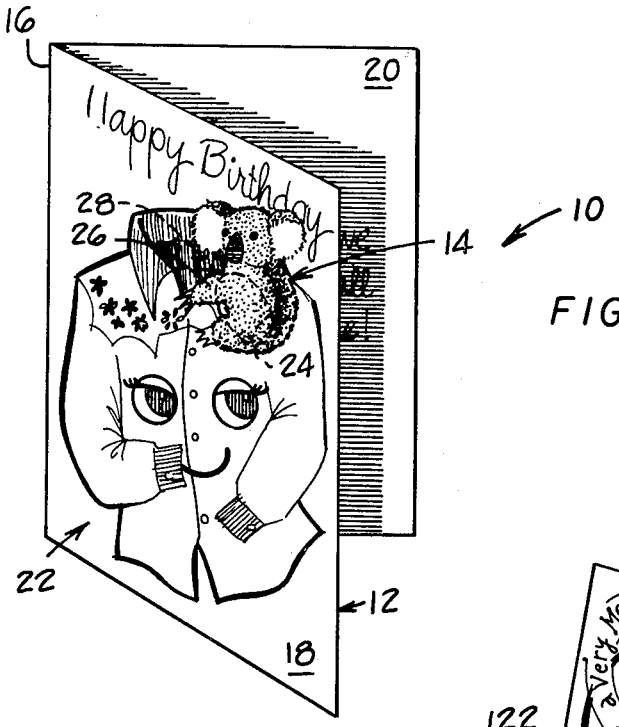
FIG. 1 is a view of a folded greeting card including a cut out portion for receiving a holding toy, indicia upon the greeting card being arranged to include the holding toy as a portion thereof.
Figure 2:
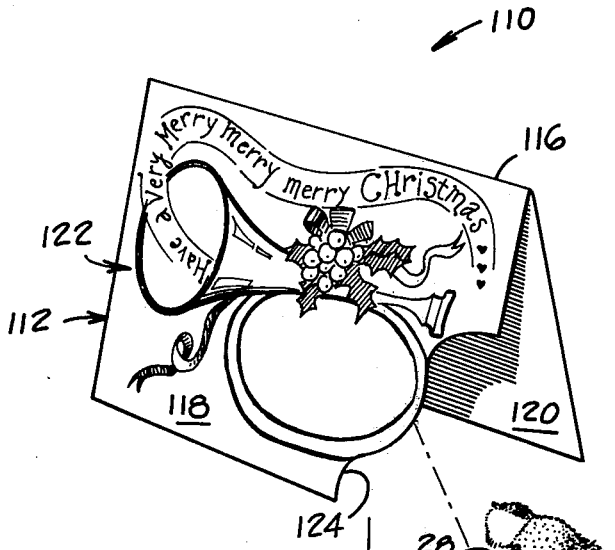
FIG. 2 is a similar view of another embodiment of the greeting card and holding toy combination of the present invention.
Figure 2:
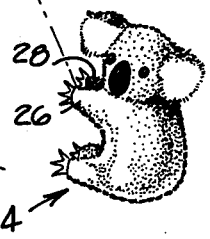
Figure 3:
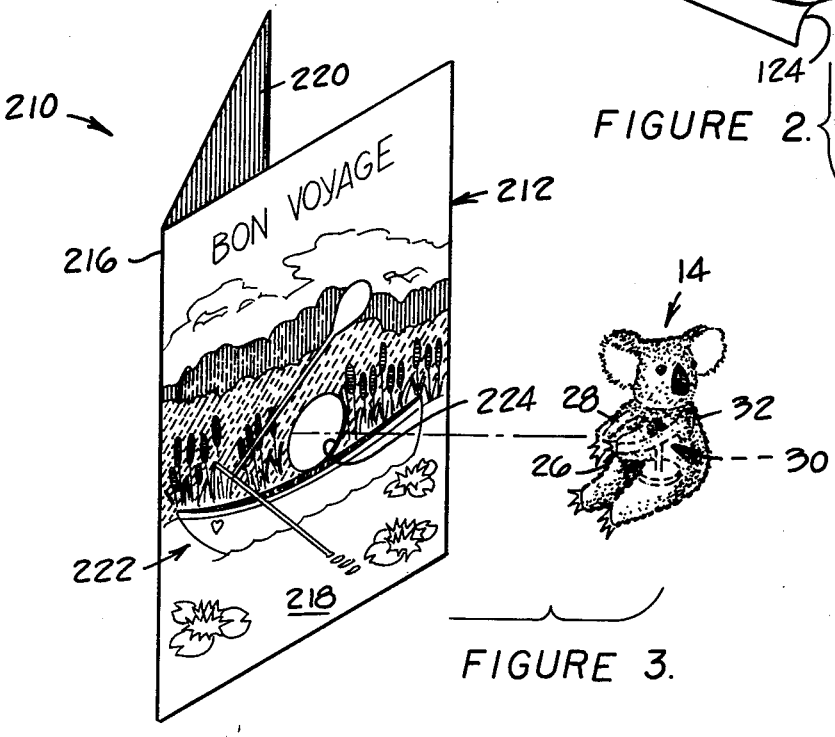
FIG. 3 is also a similar view of yet another embodiment of the greeting card and holding toy combination of the invention.

In accordance with the preceding description, various embodiments of greeting card and holding toy combinations are indicated respectively in FIGS. 1, 2 and 3 at 10, 110 and 210. Greeting cards within each of the combinations 10, 110 and 210 are indicated respectively at 12, 112 and 212. A similar holding toy is indicated at 14 in all of the figures, in combination with the greeting card in a manner described in greater detail below.

Referring particularly to FIG. 1, the greeting card 12 is folded at 16 to form a front panel 18 and a rear panel 20. Decorative indicia 22 is printed or otherwise formed upon the front panel 18 while a cut out 24 is arranged to receive the holding toy 14. Within the embodiment of FIG. 1, the greeting card 12 is preferably a birthday card including the salutation "Happy Birthday" and the indicia 22 is a representation of a shirt with the cut out 24 being arranged so that the holding toy 14, upon being arranged within the cut out 24, appears to have its upper limbs clasping or hugging the collar of the shirt.

Due to the location of the cut out 24, the holding toy 14 is thus arranged upon the greeting card within the outline of both the front and rear panels 18 and 20. This feature facilitates placement of the greeting card within an envelope while providing protection for the holding toy and tending to prevent the holding toy from being accidentally removed or displaced from the greeting card.

Similarly, in FIG. 2, the greeting card 112 is folded as indicated at 116 to form a front panel 118 and rear panel 120. Decorative indicia 122 is printed or formed upon the front panel 118 including the representation of a horn or trumpet and the salutation "Have a Merry, Merry Christmas." A cut out 124 is arranged so that, with the holding toy 14 mounted in place within the cut out, it appears to be playing the horn or instrument of the indicia.

In addition, within FIG. 2, the cut out 124 is formed along one edge portion of the front panel 118. Accordingly, with the holding toy 14 being arranged within the cut out 124, it is disposed within an outline formed by the rear panel 120.

The embodiment 210 in FIG. 3 also includes a greeting card 212 which is folded as indicated at 216 to form a front panel 218 and a rear panel 220. Indicia 222 is printed or formed upon the front panel 218 and includes a canoe or boat with a cut out 224 being formed immediately above a central portion of the canoe. Accordingly, the holding toy 14 upon being clipped in place within the cut out 224 of the greeting card 212 appears to be riding in the canoe of the indicia.

As indicated above, construction of the holding toy 14 is described in detail within U.S. Pat. No. 3,928,933 which is incorporated by reference herein. The holding toy 14 is preferably configured as an animal such as a bear as illustrated. However, the holding toy could also be in the form of other animals such as monkey, dogs or the like.

Preferably, the holding toy has movable upper limbs 26 and 28 and an internal spring-loaded mechanism generally indicated at 30 which tends to urge the upper limbs 26 and 28 toward each other. The limbs 26 and 28 may be separated from each other for example by pressing upon the shoulders 32 of the holding toy. In such a configuration, the holding toy may be arranged in place within the cut out for any of the cards in FIGS. 1, 2 and 3. The shoulders 32 may thereafter be released so that the limbs 26 and 28 are caused to move toward each other by the spring loaded mechanism 30 so that the holding toy tends to maintain its position upon the card. The holding toy may of course also be removed from the card and secured in the same manner to other objects where it is desired to employ the holding toy as a decoration.

Various modifications are of course possible within the invention as described above. For example, a greeting card according to the present invention could be formed as a single panel such as one of the front panels 18, 118 or 218 absent the respective rear panel. The holding toy 14 arranged within the cut out for each card would still be disposed within an outline formed by the card. Other variations and modifications are also apparent within the scope of the present invention which accordingly is defined only by the following appended claims.

I claim:

1. A greeting card and holding toy combination comprising a greeting card having decorative indicia thereupon and forming a cut out portion adjacent the indicia, a holding toy having movable limbs operable by a spring-loaded mechanism and arranged within the cut out portion of the card to form a portion of the decorative indicia, the holding toy being removable from the card and employable separately therefrom.

2. The greeting card and holding toy combination of claim 1 wherein the cut out portion of the card has a selected size and arrangement upon the card to receive the holding toy within the outline of the entire card.

3. The greeting card and holding toy combination of claim 2 wherein the greeting card is folded to include a front panel having the indicia and cut out formed thereupon and a rear panel.

4. The greeting card and holding toy combination of claim 3 wherein the cut out portion is formed along a peripheral portion of the front panel so that the outline of the greeting card is formed only by the rear panel.

5. The greeting card and holding toy combination of claim 3 wherein the cut out portion is formed within a generally central portion of the front panel.

6. The greeting card and holding toy combination of claim 1 wherein the holding toy is formed as an animal having movable upper limbs which are operated by said spring mechanism.

7. The greeting card and holding toy combination of claim 6 wherein said cut out portion is formed in a generally central portion of the greeting card so that the holding toy is entirely disposed within the outline formed by the periphery of the card while forming a portion of the decorative indicia thereupon.

8. The greeting card and holding toy combination of claim 1 wherein said cut out portion is formed in a generally central portion of the greeting card so that the holding toy is entirely disposed within the outline formed by the periphery of the card while forming a portion of the decorative indicia thereupon.

* * * * *